US006111488A

United States Patent [19]

Nakamura et al.

[11] Patent Number: 6,111,488

[45] Date of Patent: Aug. 29, 2000

[54] ELECTROMAGNETIC CONTACTOR

[75] Inventors: Yutaka Nakamura; Takato Hirota; Kouetsu Takaya, all of Saitama, Japan

[73] Assignee: Fuji Electric Co., Ltd., Kawasaki, Japan

[21] Appl. No.: 09/357,210

[22] Filed: Jul. 20, 1999

[30] Foreign Application Priority Data

Aug. 25, 1998 [JP] Japan ..... 10-238233

[51] Int. Cl.[7] ..... H01H 67/02

[52] U.S. Cl. ..... 335/132; 335/202

[58] Field of Search ..... 335/78–86, 128, 335/131, 132, 202; 200/293–305

[56] References Cited

U.S. PATENT DOCUMENTS 5,600,291 2/1997 Duchemin et al. ..... 335/132

5,684,442 11/1997 Hufschmid ..... 335/132

5,933,064 8/1999 Hilfiker ..... 335/132

FOREIGN PATENT DOCUMENTS 8-255545 10/1996 Japan .

*Primary Examiner*—Lincoln Donovan

*Attorney, Agent, or Firm*—Kanesaka & Takeuchi

[57] ABSTRACT

An electromagnetic contactor is formed of upper and lower cases. Recesses are formed on opposite sides of the upper case, while guide walls that fit the recesses are provided on two opposite sides of the lower case to extend toward the upper case. The recesses and the guide walls can be fitted together even when the upper case is rotated by 180° relative to the lower case. Therefore, the upper and lower cases can be attached to each other even if the upper case is rotated by 180° relative to the lower case.

5 Claims, 6 Drawing Sheets

ELECTROMAGNETIC CONTACTOR

BACKGROUND OF THE INVENTION AND RELATED ART STATEMENT

The present invention relates to an electromagnetic contactor opened and closed in order to feed electric power to motors and so on, and in particular to an electromagnetic contactor that can be mounted even if an upper case is rotated by 180° relative to a lower case.

FIG. 6 is a sectional view showing the configuration of a conventional electromagnetic contactor. A fixed iron core 6, and an electromagnetic coil 5 wound around a central leg of the fixed iron core 6 via a reel 3 are housed in an insulating lower case 2. An insulating upper case 1 is provided above the lower case 2, and a movable iron core 4 opposed to the upper end surface of the fixed iron core 6, a movable holder 8 operating in response to the movement of the movable iron core 4, and contacts opened and closed in response to the movement of the movable holder 8 are housed in the upper case 1. These contacts consist of two pairs of contacts laterally spaced apart from each other, and each pair consists of a movable contact 90A and a fixed contact 10A. The two movable contacts 90A are held by the movable holder 8 via a movable contact shoe 90, and are always urged downward by a contact spring 12.

On the other hand, the two fixed contacts 10A are fixed to the upper case 1 via fixing contact shoes 10. The two fixing contact shoes 10 are connected to main circuit terminal portions 21 disposed outside the upper case 1. In addition, the movable iron core 4 is always urged upward by a return spring 11. Furthermore, two coil terminal portions 9 (in FIG. 6, they are arranged in parallel in the rear direction) are provided on the right sides of the upper and lower cases 1 and 2, and are connected to starting and end conductors, respectively, of the electromagnetic coil 5 via feeding leads (not shown). The upper and lower cases 1 and 2 are connected together by wire springs 7, screws, or snap fits (not shown).

A switching mechanism of the electromagnetic contactor shown in FIG. 6 is described below. A power-side main circuit and a load-side main circuit (not shown) are connected to the right and left terminal portions 21, and a control power circuit (not shown) is connected to the coil terminal portions 9. In the configuration shown in FIG. 6, the contacts are open and no current flows between the right and left contact shoes 10. Under these conditions, when a control current is supplied to the coil terminal portions 9 from the control power circuit, the electromagnetic coil 5 is excited and the fixed iron core 6 attracts the movable iron core 4 against the force of the return spring 11. Accordingly, the movable holder 8 moves downward, so that the movable contact shoe 90 also moves downward to contact the movable contacts 90A with the fixed contacts 10A. Thus, the two fixed contact shoes 10 are shorted via the movable contact shoe 90 to close the main circuit. With the electromagnetic contactor in the closed state, the contact spring 12 urges the movable contact shoe 90 downward to maintain the pressure between the contacts, thereby constantly maintaining good contact conditions.

Next, with the electromagnetic contactor in the closed state, when the excitation of the electromagnetic coil 5 is shut off, the return spring 11 moves the movable iron core 4 upward. The movable contact shoe 90 simultaneously moves upward via the movable holder 8 to release the movable contacts 90A from the fixed contacts 10A, thereby opening the contacts. Thus, the two fixed contact shoes 10 are separated to open the main circuit.

In the above conventional apparatus, however, the user may desire to rotate the electromagnetic coil terminal by 180°, and in this case, the electromagnetic contactor body must be rotated by 180°. As a result, a name plate and a terminal number indication provided on the top surface of the upper case are reversed to confuse the operator during a wiring or inspecting operation.

Therefore, it is an object of this invention to enable the upper and lower cases to be attached to each other such that the upper case can be rotated by 180° relative to the lower case.

SUMMARY OF THE INVENTION

To achieve this object, the invention provides an electromagnetic contactor comprising an insulating lower case having housed therein a fixed iron coil and an electromagnetic coil wound around the fixed iron coil via a reel, and an insulating upper case having housed therein a movable iron core opposed to the fixed iron core and contacts that are opened and closed in response to the movement of the movable iron core. The lower and upper cases are connected together, and coil terminal portions are formed on one side of the lower case to feed power to the electromagnetic coil. Recesses are formed on two opposite sides of the upper case, while guide walls that fit the recesses are provided on the sides of the lower case in such a way as to extend toward the upper case. Also, the recesses and guide walls can be fitted together even if the upper case is rotated by 180° relative to the lower case. This configuration allows the coil terminal portion to be moved to the opposite position by rotating only the lower case by 180° without changing the direction of the upper case.

In addition, in such a configuration, one pair of guide walls may be disposed on both sides of the coil terminal portions to sandwich the same, and the guide walls may be perpendicular to the side of the lower case. This configuration allows the guide walls to be used as external walls for the coil terminal portions as well.

In addition, in such a configuration, the other pair of the guide walls may be arranged parallel to the side of the lower case. This configuration allows the guide walls to occlude the recesses.

In addition, in such a configuration, the other pair of the guide walls may be integrated with the reel. According to this configuration, in case the electromagnetic coil is to be assembled in the lower case, if an attempt is made by mistake to insert the reel with the electromagnetic coil wound around it in the opposite direction, one pair of the guide walls abuts against the other pair of the guide walls to prevent improper assembly of the electromagnetic coil.

DETAILED DESCRIPTION OF A PREFERRED EMBODIMENT

Figure 1:
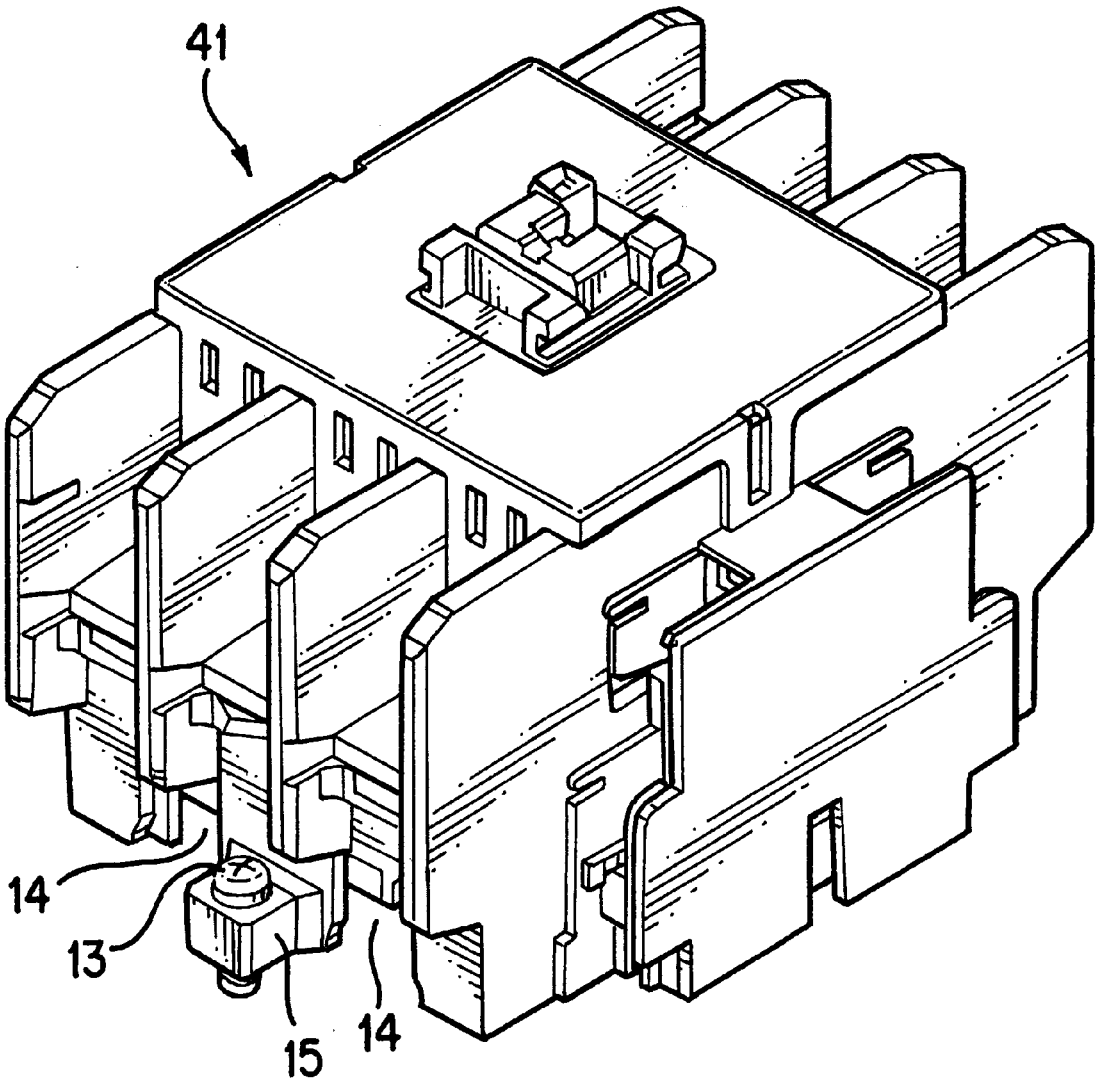
FIG. 1 is a perspective view showing a configuration of an upper case of an electromagnetic contactor according to an embodiment of this invention.

The invention will be described below based on the embodiment. FIG. 1 is a perspective view showing a configuration of an upper case of an electromagnetic contactor according to an embodiment of this invention. Recesses 14 are formed in the right and left sides of an upper case 41 at the bottom thereof (the same configuration is provided on the opposite side in FIG. 1). A fixed portion 15 integrated with the upper case 41 is provided between the recesses 14, with a setting screw 13 penetrating the fixed portion 15.

As described below, guide walls of a lower case 42 are fitted into the recesses 14, and the setting screws 13 are used to fix the upper case to the lower case.

Figure 2:
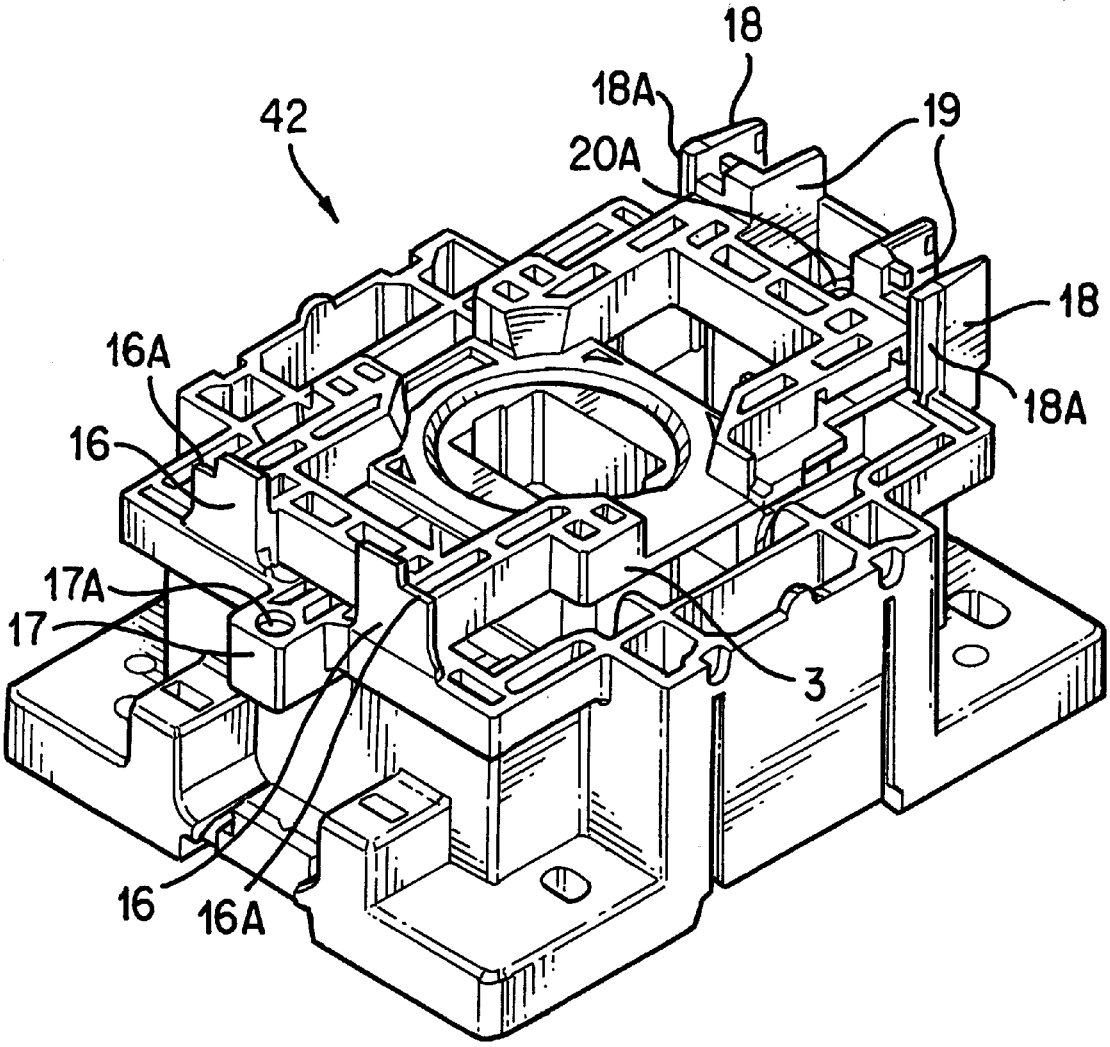
FIG. 2 is a perspective view showing a configuration of a lower case of the electromagnetic contactor according to the embodiment of this invention.

FIG. 2 is a perspective view showing a configuration of the lower case 42 of the electromagnetic contactor according to the embodiment of this invention. A pair of guide walls 16 is provided on one side (lower left of FIG. 2) of the lower case 42 in such a way as to protrude or extend upward. The guide walls 16 are integrally formed with the reel 3 and are parallel to this side of the lower case 42. On the other hand, a pair of guide walls 18 is provided on the other side (upper right of FIG. 2) of the lower case 42 in such a way as to protrude or extend upward. The guide walls 18 are integrally formed with the lower case 42, and are arranged perpendicularly to this side of the lower case 42. A pair of terminal walls 19 is provided between the pair of guide walls 18 in such a way as to protrude or extend upward, and a coil terminal portion (not shown) is interposed between the guide wall 18 and the terminal wall 19, respectively. That is, the two guide walls 18 are disposed on both sides of the coil terminal portions.

A notch 16A is formed in the guide wall 16 and a step 18A is formed on the guide wall 18, so that the guide walls 16 and 18 are fitted into the recesses 14 of the upper case 41 shown in FIG. 1. In addition, a screw-receiving portion 17 is formed below and between the pair of guide walls 16 so as to be integrally formed with the lower case 42, and has a screw hole 17A therein. The setting screw 13 shown in FIG. 1 is screwed into this screw hole 17A. A screw hole 20A is also formed between the pair of terminal walls 19 so that the setting screw is screwed therein.

Figure 3:
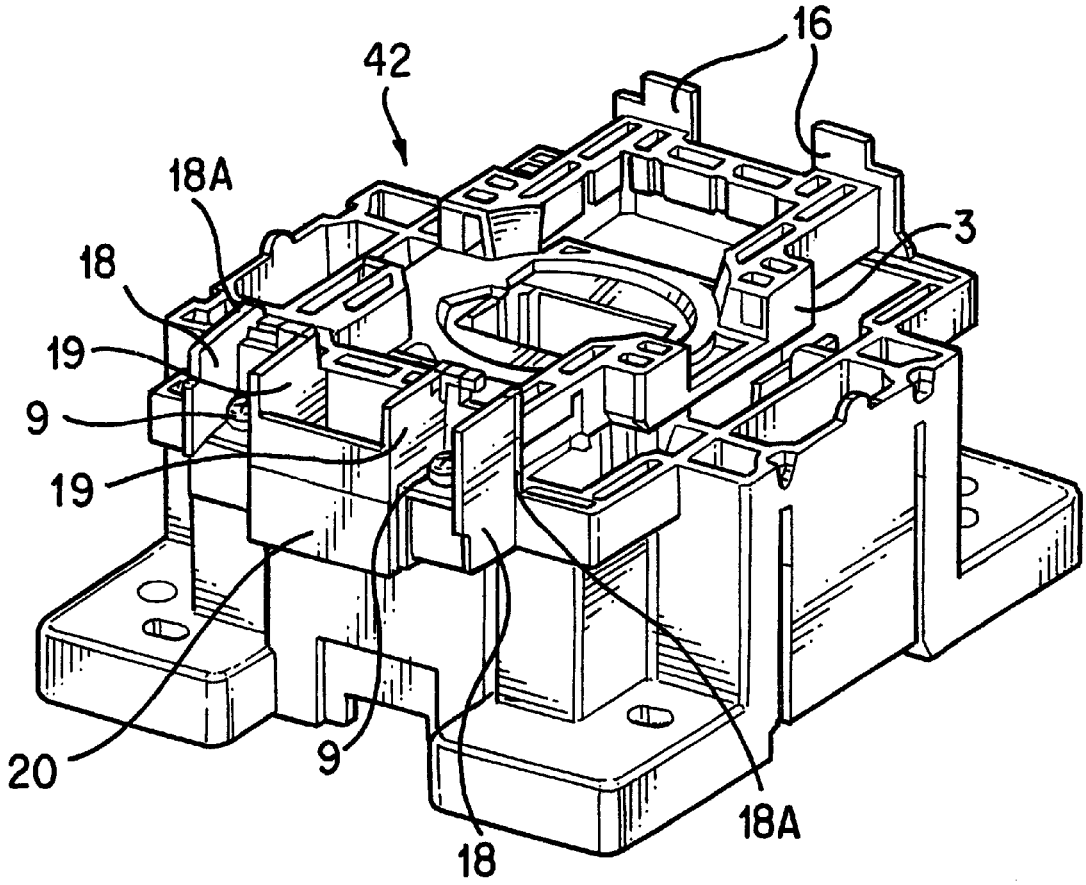
FIG. 3 is a perspective view showing a configuration in which the lower case in FIG. 2 has been rotated by 180°.
Figure 6:
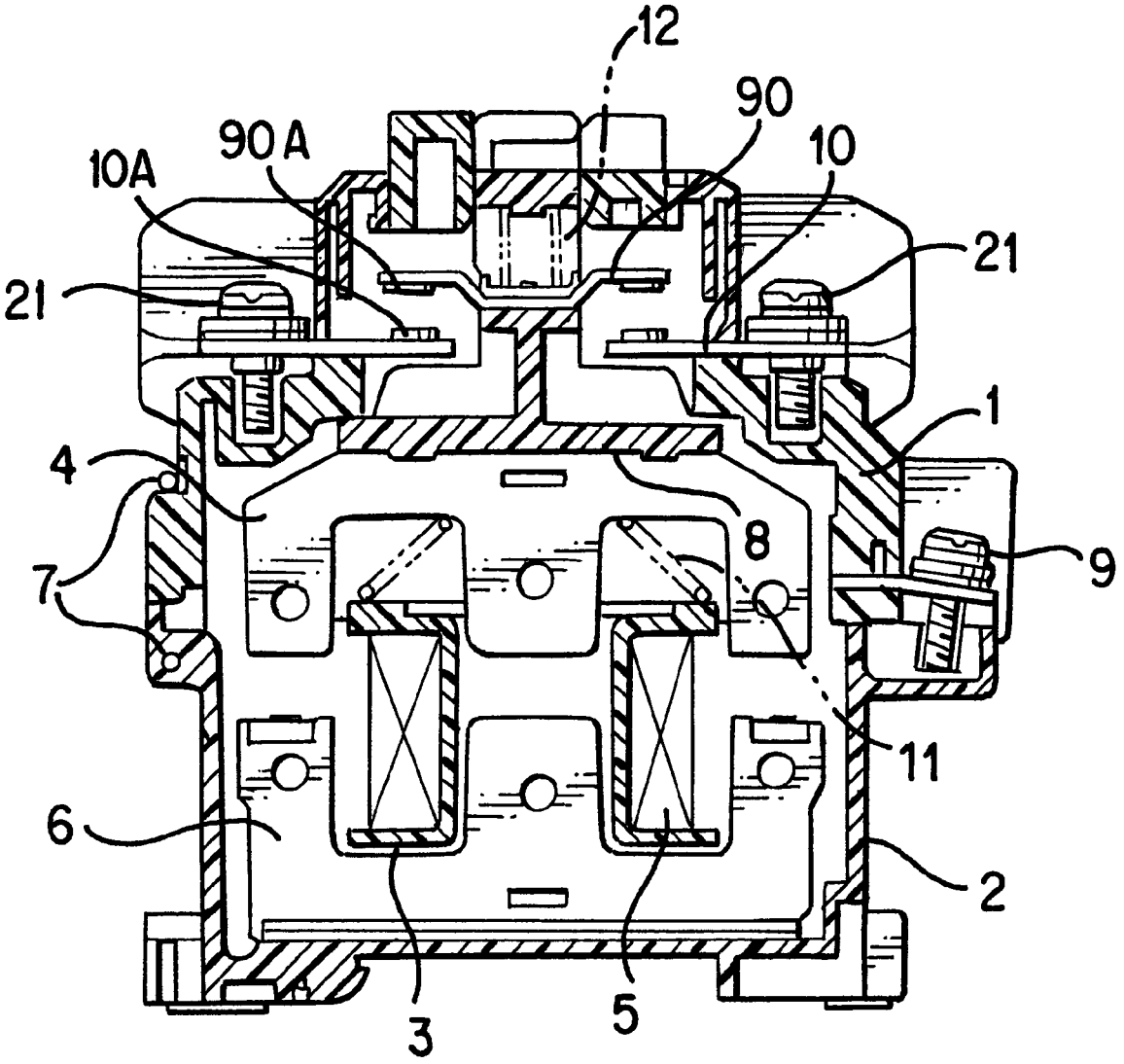
FIG. 6 PRIOR ART
FIG. 6 is a sectional view showing a configuration of a conventional electromagnetic contactor.

FIG. 3 is a perspective view showing a configuration in which the lower case 42 in FIG. 2 has been rotated by 180°. The screw hole 20A (FIG. 2) between the pair of terminal walls 19 is formed in another screw-receiving portion 20. In addition, the coil terminal portion 9 is interposed between the guide wall 18 and the terminal wall 19, respectively, as described above. The other structures shown in FIGS. 1 to 3 are the same as in the conventional structures shown in FIG. 6. The same components as in the conventional configuration have the same reference numerals and their detailed description is omitted.

Figure 4:
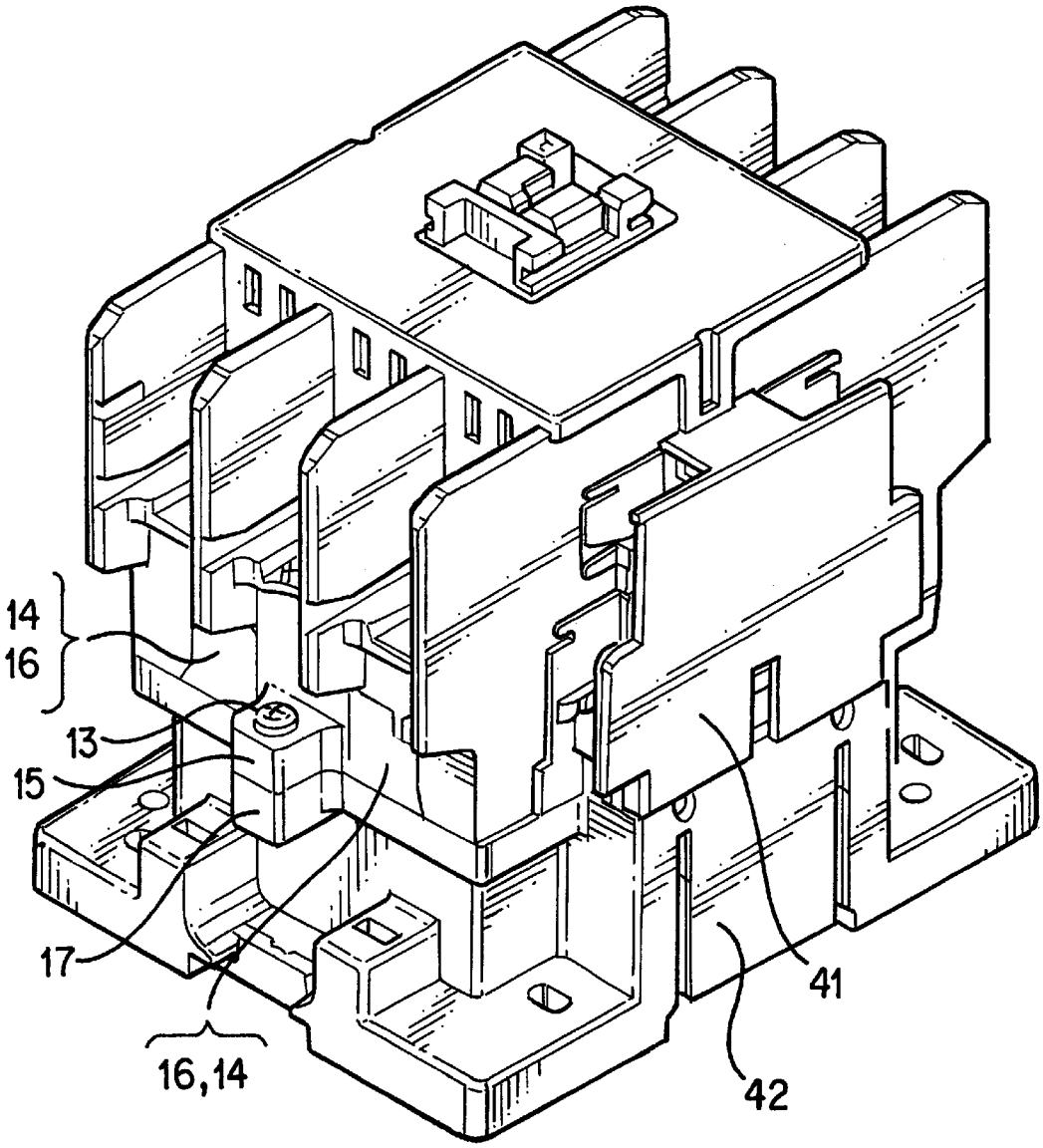
FIG. 4 is a perspective view showing a configuration of the electromagnetic contactor in which the upper case in FIG. 1 and the lower case in FIG. 2 are connected together in such a way as to maintain their directions in the respective figures.

FIG. 4 is a perspective view showing a configuration of the electromagnetic contactor in which the upper case 41 in FIG. 1 and the lower case 42 in FIG. 2 are connected together in such a way as to maintain their directions in the respective figures. The guide walls 16 and the recesses 14 are fitted together, the fixed portion 15 and the screw-receiving portions 17 are fitted together, and the setting screw 13 is used to fix the upper case 41 to the lower case 42. The state of the upper right side of the contactor shown in FIG. 4 is described below, but as in this lower left side, the guide walls and the recesses are fitted together, the fixed portion and the screw-receiving portion are fitted together, and the setting screw is used to fix the upper case 41 to the lower case 42.

Figure 5:
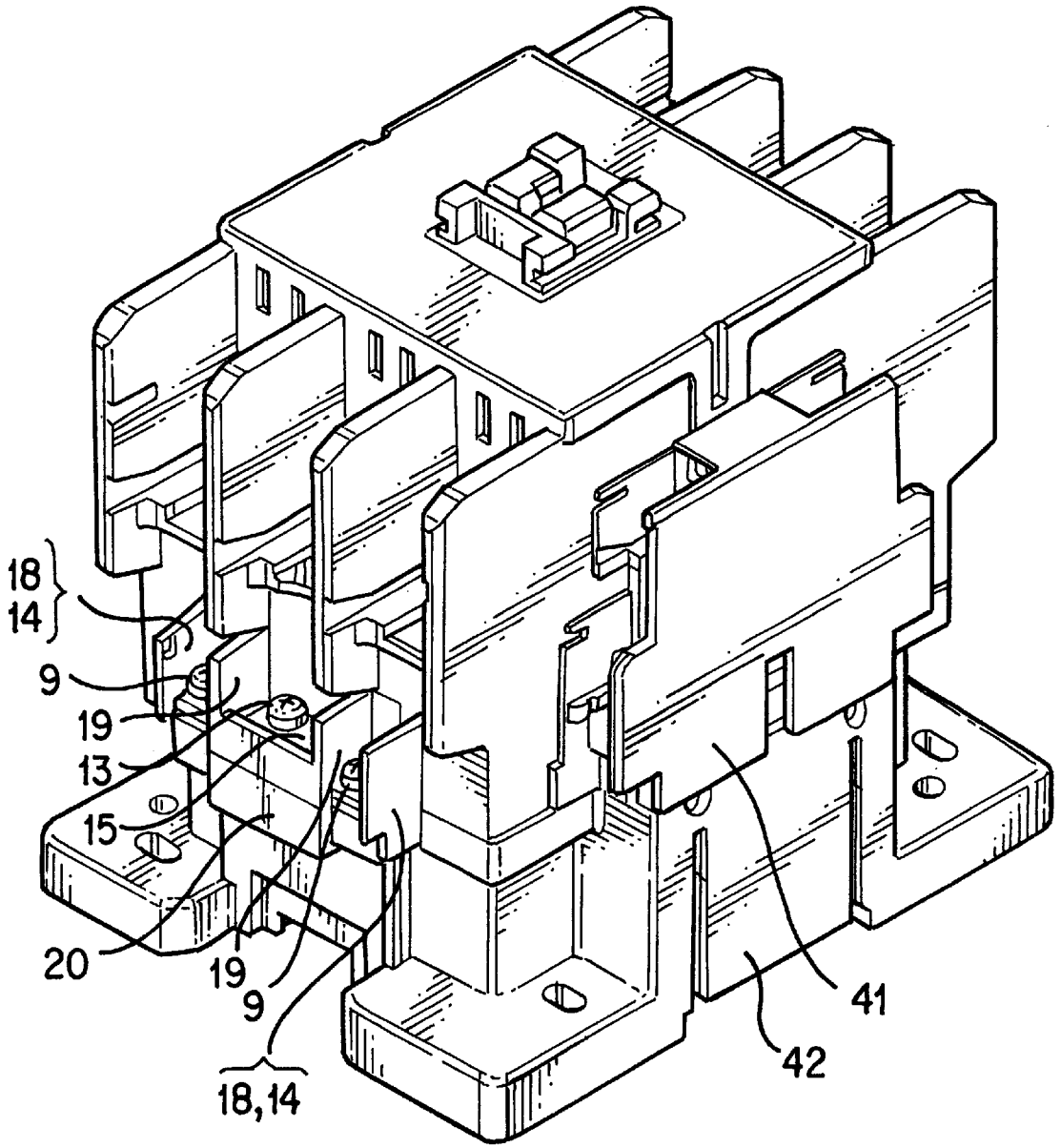
FIG. 5 is a perspective view showing a configuration of the electromagnetic contactor in which the upper case in FIG. 1 and the lower case in FIG. 3 are connected together in such a way as to maintain their directions in the respective figures.

FIG. 5 is a perspective view showing a configuration of the electromagnetic contactor in which the upper case 41 in FIG. 1 and the lower case 42 in FIG. 3 are connected together in such a way as to maintain their directions in the respective figures. That is, the lower case 42 in FIG. 4 is rotated by 180°, and the upper case 1 is placed on the lower case 42. The guide walls 18 and the recesses 14 are fitted together, the fixed portion 15 and the screw-receiving portions 20 are fitted together, and the setting screw 13 is used to fix the upper case 41 to the lower case 42.

The state of the upper right side in FIG. 5 is the same as that of the lower left side in FIG. 4. On the other hand, the state of the upper right side in FIG. 4 is also the same as that of the lower left side in FIG. 5. Thus, the upper and lower cases 41 and 42 in FIG. 4 or 5 can be connected together even if one of them is rotated by 180°. Accordingly, if the coil terminal portion 9 are to be moved to the opposite side, the entire apparatus need not be rotated by 180°. This configuration precludes the name plate and terminal number indication from being reversed, thereby preventing the operator from being confused during a wiring or inspection operation.

Referring back to FIG. 2, the guide walls 16 are integrally formed with the reel 3, as described above. Consequently, in case an electromagnetic coil is assembled in the lower case 42, if an attempt is made by mistake to insert the reel 3 with the electromagnetic coil wound around it in the opposite direction, the guide walls 16 abut against the guide walls 18 to preclude the reel 3 from being fitted into the lower case 42. This prevents improper assembly of the electromagnetic coil, thereby reducing the assembly time.

In addition, in FIG. 3, the guide walls 18 are disposed on both sides of the coil terminal portions 9 and are arranged perpendicular to this side of the lower case 42. The terminal portions 9 must be provided on both sides with terminal walls as insulating barriers, but the guide walls 18 can also be used as such terminal walls to simplify the configuration.

Furthermore, in FIG. 4, since the guide walls 16 are parallel to the side of the lower case 42, the guide walls 16 occlude the recesses to prevent dust from entering the upper case 41, thereby improving reliability.

As described above, according to this invention, the recesses are formed on opposite sides of the upper case, while the guide walls that fit into the recesses are provided on the sides of the lower case in such a way as to extend toward the upper case, and the recesses and the guide walls can be fitted together even if the upper case is rotated by 180° relative to the lower case. This configuration allows the coil terminal portions to be moved to the opposite position by rotating only the lower case by 180° without changing the direction of the upper case. As a result, the operator can be prevented from being confused during a wiring or inspection operation.

In addition, in such a configuration, one pair of the guide walls is disposed on both sides of the coil terminal portions, and are disposed perpendicular to one side of the lower case. Thus, the guide walls can also be used as the external walls for the coil terminal portions to simplify the configuration.

In addition, in such a configuration, the other pair of the guide walls is arranged parallel to another side of the lower case. This configuration allows the guide walls to occlude the recesses in order to improve reliability.

In addition, in such a configuration, the other pair of the guide walls is integrally formed with the reel. This configuration prevents improper assembly of the electromagnetic coil, thereby reducing assembly time.

What is claimed is:

1. An electromagnetic contactor comprising, an insulating lower case having therein a fixed iron core, an electromagnetic coil wound around the fixed iron core, coil terminal portions formed on one side of the lower case for feeding power to the coil, and guide walls operating as first fitting portions and formed at two opposite sides of the lower case, said guide walls protruding upwardly from the two opposite sides of the lower case and having a pair of first guide walls disposed on two outer sides of the coil terminal portions and arranged perpendicular to said one side of the lower case where the coil terminal portions are formed, and an insulating upper case connected to the lower case and having therein a movable iron core opposed to the fixed iron core, contacts attached to the movable iron core to be opened and closed in response to a movement of the movable iron core, and recesses operating as second fitting portions and formed at two opposite sides of the upper case to fit the guide walls of the lower case, said guide walls of the lower case fitting into the recesses of the upper case even if one of the upper and lower cases is rotated by 180° relative to the other.

2. An electromagnetic contactor according to claim 1, wherein said first fitting portions further include a pair of second guide walls at a side opposite to the first guide walls, said second guide walls being parallel to the side of the lower case.

3. An electromagnetic contactor according to claim 2, wherein said second guide walls are integrally formed with a reel for the electromagnetic coil.

4. An electromagnetic contactor comprising, an insulating lower case having therein a fixed iron core, a reel disposed in the lower case, an electromagnetic coil wound around the reel to be located around the fixed iron core, coil terminal portions situated at one side of the lower case for feeding power to the coil, and guide walls formed on two opposite sides of the lower case to protrude upwardly therefrom, said guide walls having a pair of first guide walls disposed on said one side and located on two outer sides of the coil terminal portions, said first guide walls being integrally formed with the lower case and arranged perpendicular to said one side of the lower case where the coil terminal portions are disposed, and second guide walls situated at a side opposite to the first guide walls to be spaced apart from each other and integrally formed with the reel, and an insulating upper case connected to the lower case and having therein a movable iron core opposed to the fixed iron core, contacts to be opened and closed in response to a movement of the movable iron core, and recesses formed at two opposite sides of the upper case to fit the guide walls of the lower case, said guide walls of the lower case fitting into the recesses of the upper case even if one of the upper and lower cases is rotated by 180° relative to the other.

5. An electromagnetic contactor according to claim 4, wherein said lower case further includes a pair of terminal walls between the first guide walls, one coil terminal portion being sandwiched between one of the first guide walls and one of the terminal walls.

* * * * *